United States Patent [19]

Pool

[11] Patent Number: 4,713,869

[45] Date of Patent: Dec. 22, 1987

[54] FRONT WHEEL DRIVE BOOT REMOVAL TOOL

[75] Inventor: James L. Pool, Clarinda, Iowa

[73] Assignee: Lisle Corporation, Clarinda, Iowa

[21] Appl. No.: 858,644

[22] Filed: May 2, 1986

[51] Int. Cl.[4] ..... B25B 27/14

[52] U.S. Cl. ..... 29/275

[58] Field of Search ..... 173/90, 131, 132, 128; 81/463; 29/252, 251, 254, 255, 263, 270, 275, 276, 278, 280

[56] References Cited

U.S. PATENT DOCUMENTS

| | | | |
|---|---|---|---|
| 1,465,124 | 8/1923 | Gardner | 29/263 |
| 1,512,422 | 10/1924 | Hatcher et al. | 29/251 |
| 1,512,818 | 10/1924 | Bumpus | 29/275 |
| 1,585,707 | 5/1926 | Hartsock | 29/263 |
| 2,454,771 | 11/1948 | Carr | 29/275 |
| 4,021,904 | 5/1977 | Constant | 29/263 |
| 4,185,372 | 1/1980 | Dupree et al. | 29/275 |
| 4,305,194 | 12/1981 | Keener | 29/251 |
| 4,512,222 | 4/1985 | Christophersen | 29/276 |
| 4,586,230 | 5/1986 | Harydzak et al. | 29/254 |

*Primary Examiner*—Robert C. Watson

*Attorney, Agent, or Firm*—Allegretti, Newitt, Witcoff & McAndrews

[57] ABSTRACT

A tool to remove the universal joint boot of a front wheel drive vehicle is disclosed. The tool includes a U-shaped yoke and two differently sized split rings which are individually secured to the U-shaped yoke. The tool further includes a driver attachment affixedly attached to the yoke to accommodate an air hammer.

2 Claims, 5 Drawing Figures

Fig. 1
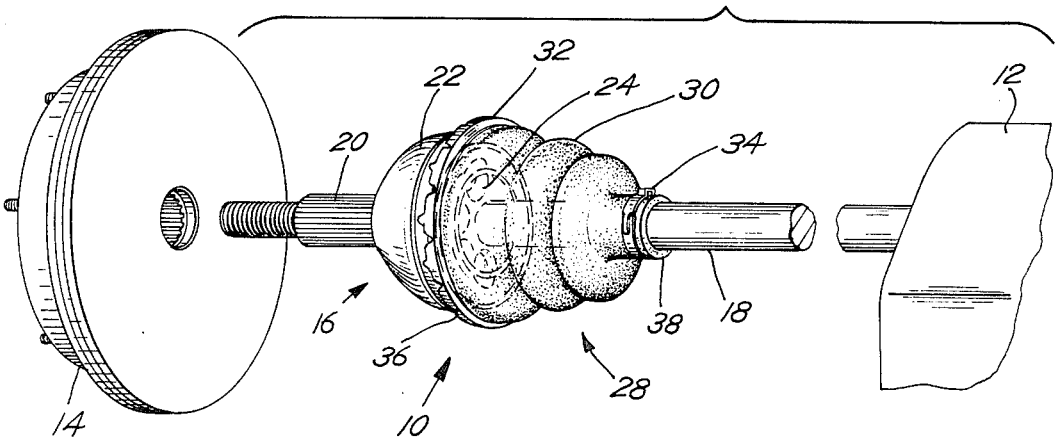
Fig. 4
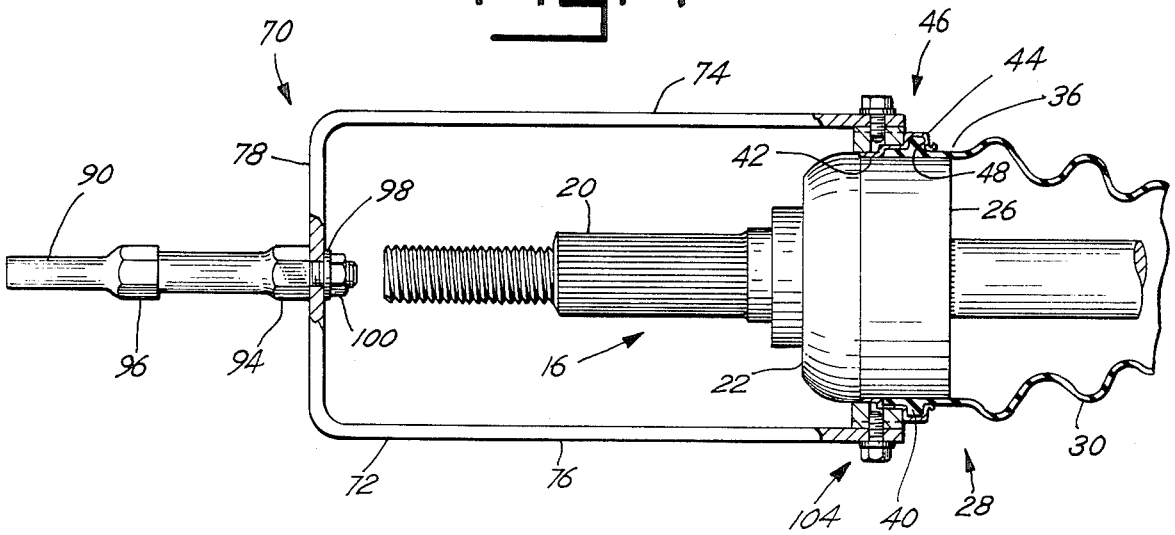
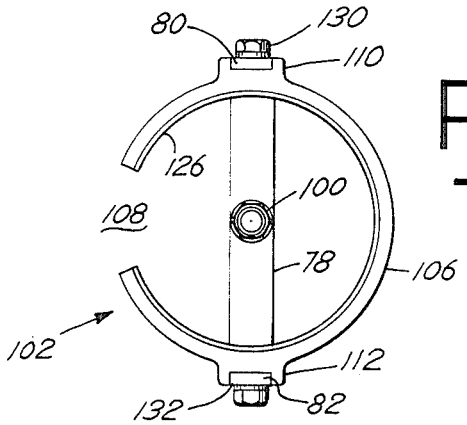
Fig. 5

FRONT WHEEL DRIVE BOOT REMOVAL TOOL

BACKGROUND OF THE INVENTION

The present invention relates generally to a front wheel drive vehicle and more particularly to a tool for removal of the boot assembly covering the front wheel drive universal joint.

Over the past five years, front wheel drive has become more and more popular and commonplace. With front wheel drive, the engine is connected to the tire assembly through a universal joint, including a lubricated bearing. The universal joint is covered and sealed from road dirt and moisture by a boot assembly, force-fitted over the housing of the universal joint.

Periodically the universal joint must be serviced to avoid failure. That is, the bearing is removed, cleaned, repacked with lubricant, and replaced. In order to gain access to the bearing, the boot assembly must be removed.

In the past, the removal process has been difficult and time-consuming, utilizing a hammer and chisel-like tool to drive the boot assembly from the bearing housing. Recently a boot removal tool, facilitating both removal and application of the boot assembly, has been introduced. This tool is shown in FIG. 2 and designated "PRIOR ART."

This boot removal tool includes a first ring welded to a U-shaped yoke. The first ring is split to receive the drive shaft as the tool is positioned. The first ring includes a land adapted to engage the edge of the boot assembly, such that upon application of a force the boot assembly is driven from the universal joint housing. A second ring slideably fits within the first ring, abutting the land, to accommodate a second size, smaller boot configuration.

SUMMARY OF THE INVENTION

The present invention is an improved boot removal tool. As in the "PRIOR ART" tool shown in FIG. 2, the present invention includes a first and second split ring to accommodate the two common boot sizes. Th present invention further includes a U-shaped yoke.

The improvement resides in the removability and interchangability of the split rings, the structural rigidity of the tool, and its adaptability to use with an air hammer. Each split ring is removably securable to the U-shaped yoke. As such, all components of the boot removal tool are rigidly interconnected during the removal process, i.e., there are no loosely fitting parts. Safety is thus enhanced and operation is significantly facilitated.

The U-shaped yoke is an integral unit, without joints or welds. Since the boot removal tool will be repeatedly subjected to strong driving forces, such as by a hammer or an air hammer, the strength of the U-shaped yoke is significant, and the integral U-shaped yoke of the present invention substantially reduces the likelihood of fracture.

Finally, a driver attachment is secured to the interconnecting leg of the U-shaped yoke. The attachment is adapted for use with a conventional air hammer to remove tight-fitting boot assemblies.

It is thus an object of the present invention to provide a new, improved boot removal tool for use with front wheel drive vehicles. Another object is a boot removal tool with at least two split rings of different sizes, each being securable to a U-shaped yoke.

Still another object of the present invention is an improved boot removal tool including an integral U-shaped yoke to substantially increase the overall strength and rigidity of the tool. It is a further object to provide a boot removal tool including an air hammer attachment.

These and other features, advantages, and objects of the present invention are set forth or implicit in the following description.

BRIEF DESCRIPTION OF THE DRAWING

Preferred embodiments of the present invention are described, in detail, with reference to the drawing wherein:

FIG. 1 is a partial perspective view of a front wheel drive vehicle;

FIG. 4 is a partial side, partial cross-sectional view of the preferred embodiment shown in FIG. 3, utilizing a second sized split ring for purposes of illustration, as applied to the front wheel drive vehicle shown in FIG. 1; and FIG. 5 is an end view of the tool shown in FIG. 3.

DETAILED DESCRIPTION OF PREFERRED EMBODIMENTS

Figure 2:
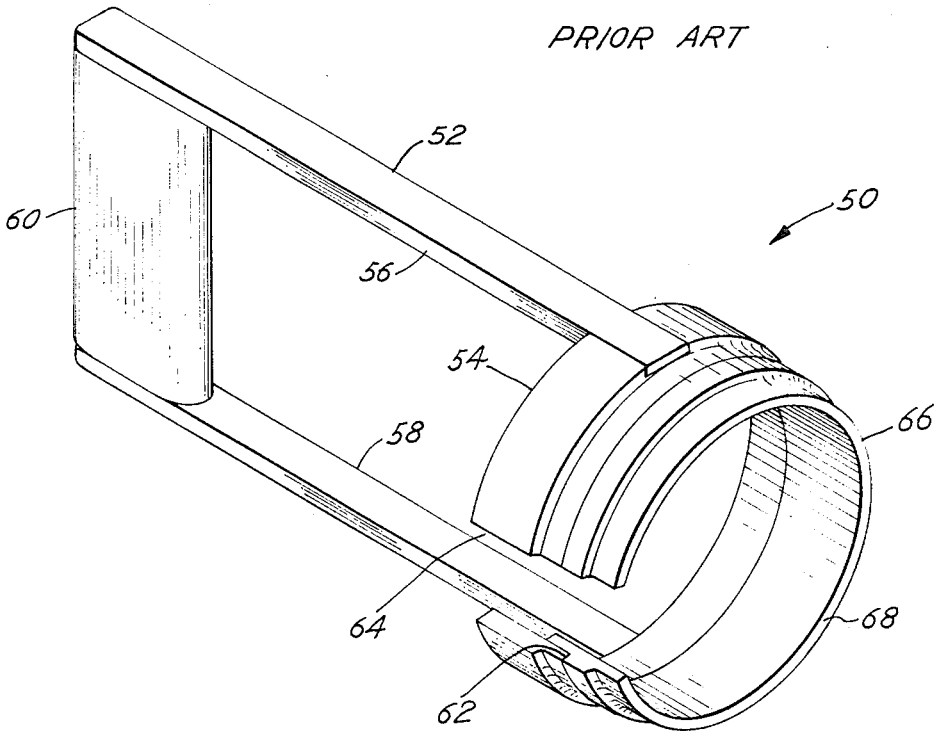
Fig. 2 PRIOR ART
FIG. 2 is a perspective view of a "PRIOR ART" tool.

Referring to FIG. 1, a front wheel drive vehicle 10 is shown schematically. The vehicle 10 includes an engine 12 interconnected to a tire assembly 14 through a universal joint 16. More particularly, a drive shaft 18 interconnects the engine 12 and universal joint 16, and a spindle or axle 20 interconnects the tire assembly 14 and universal joint 16.

The universal joint 16 includes a substantially conical housing 22, opening towards the engine 12. A bearing 24 fits within the housing 22 in a conventional manner. The open end 26 of the housing 22 is closed and sealed against dirt, debris, and moisture by means of a boot assembly 28, friction-fitted over the open end 26. There are two conventional boot sizes.

As best shown in FIGS. 1 and 2, the boot assembly 28 includes a flexible, substantially conical boot 30, a metal boot clamp 32, and a fastener 34. The boot 30 is rubber and defines large and small open ends 36, 38, respectively. A lip 40 extends circumferentially about the large open end 36.

The metal boot clamp 32 is also substantially conical, having a substantially cylindrical small clamp end 42 and a large clamp end 44. The small clamp end 42 increases in diameter incrementally so as to define a pair of shoulders, generally designated 46. The large clamp end 44 defines a groove 48 and is adapted to interlockingly receive the large open end 36 of the boot 30 in the assembled state, i.e., the lip 40 engages the groove 48. The metal boot clamp 32 is force-fitted upon the housing 22, tightly sealing the boot 30 to the housing 22. The fastener 34 seals the small open end 30 of the boot 30 to the drive shaft 18.

To service the bearing 24, the fastener 34 is released and the boot 30 and metal boot clamp 32 are driven from the housing 22 of the universal joint 16, exposing the bearing 24. The bearing 24 is then removed, thoroughly cleaned, repacked, and replaced.

Referring now to FIG. 2, marked "PRIOR ART", a boot removal tool 50 is shown. The tool 50 includes a U-shaped yoke 52 and a first split ring 54, fixedly secured to the yoke 52 by welding. The yoke 52 includes two substantially parallel legs 56, 58, and an interconnecting arm 60, also joined by welds. The first split ring 54 includes a first circumferential land 62 adapted to engage the metal boot clamp 32 during the removal process. The split or opening 64 in the ring 54 is adapted to receive the axle 20 as the tool 50 is properly positioned with respect to the universal joint 16 and boot assembly 28.

The boot removal tool 50 further includes a second split ring 66 adapted to slideably fit within the first split ring 54, engaging the land 62. The second split ring 66 itself defines a second circumferential land 68, having a diameter less than the first land 62, adapted for use with the smaller sized boot assembly 28.

Figure 3:
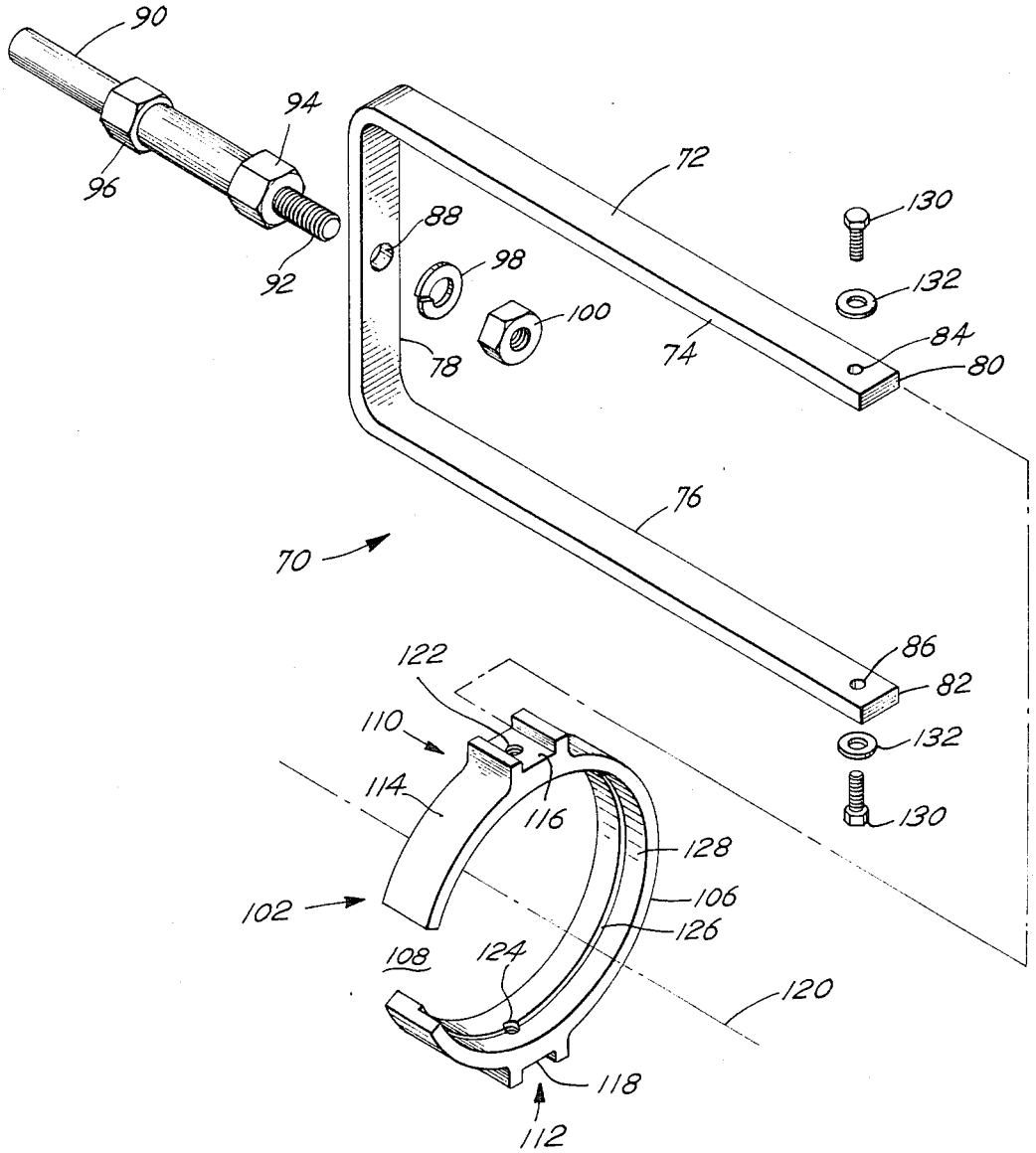
FIG. 3 is an exploded perspective view of the present invention.

The present invention is shown in FIGS. 3–5 as an improved boot removal tool 70. The boot removal tool includes an integral U-shaped yoke 72, having extension legs 74, 76 and an interconnecting leg 78. The yoke 72 is preferably formed from a single metal bar so as to be free from joints or welds. As such, the structural integrity of the U-shaped yoke 72, as well as the tool 70, is substantially enhanced over the "PRIOR ART" tool 50.

As best shown in FIG. 3, the U-shaped yoke 72 is substantially rectangular in cross section. The extension legs 74, 76 have substantially rectangular ends 80, 82, respectively, opposite the interconnecting leg 78, and the ends 80, 82 include ring-locking apertures 84, 86, respectively. The ring-locking apertures 84, 86 are substantially coaxial.

The interconnecting leg 78 of the U-shaped yoke 72 includes an attachment-locking aperture 88. The attachment-locking aperture 88 is centrally located between the extension legs 74, 76 and extends substantially perpendicular to the ring-locking apertures 84, 86.

The boot removal tool 70 also includes an integral, preferably machined driver attachment 90. As shown, the driver attachment 90 is substantially cylindrical in shape having a reduced, threaded end 92, adapted to engage the attachment-locking aperture 88. The attachment 90 further includes a stop 94, immediately adjacent the threaded end 92, and an intermediate grip 96. The stop 94 and grip 96 preferably have a bolt configuration, i.e., a hexagonal shape. The driver attachment 90 is secured to the yoke 72 by means of a lock washer 98 and nut 100, as shown in FIGS. 3 and 4. The bolt configuration of the stop 94 facilitates attachment. The grip 96 is adapted to snuggly engage an air hammer adapter (not shown).

The boot removal tool 70 further includes a pair of split rings 102, 104 adapted to be individually secured to the U-shaped yoke 72. Each split ring 102, 104 is integral and preferably cast to further enhance the strength of the boot removal tool 70.

The split rings 102, 104 have substantially identical configurations, differing only in dimensions as more fully described herein. As such, only split ring 102 will be described in detail.

The split ring 102 is substantially annular, including a C-shaped section 106 and defining a split or opening 108. The split 108 extends approximately 20°–40°.

The split ring 102 includes two pair of flanges 110, 112 extending outwardly from the substantially cylindrical, exterior surface 114 of the C-shaped section 106. As shown, the flange pairs 110, 112 defines slots 116, 118, respectively, which extend in a substantially parallel relationship to each other and are substantially colinear with the axis 120 of the split ring 102 shown in FIG. 3. The slots 116, 118 are diametrically opposed, i.e., separated by 180° along the exterior surface 114 of the split ring 102, and equally spaced from the split 108.

The split ring 102 defines fastening apertures 122, 124 centrally located within the slots 116, 118, respectively. The fastening apertures 122, 124 are threaded and substantially coaxial.

The split ring 102 further defines an interior circumferential land or abutment surface 126. As shown, the land 126 is substantially perpendicular to the substantially cylindrical, interior surface 128 of the C-shaped section 106.

The split ring 104 is dimensionally altered with respect to the split ring 102 such that the diameter of the interior surface 128 is less and adapted for use with the smaller sized boot assembly 28. In one embodiment, the thickness of the C-shaped section 106 is increased. In the preferred embodiment, the size of the C-shaped section 106 is reduced (the thickness thereof remaining the same), and the slots 116, 118 as defined by the flange pairs 110, 112 are raised with respect to the exterior surface 114.

The slots 116, 118 of the split rings 102, 104 slideably receive the ends 80, 82 of the U-shaped yoke 72, such that the ring-locking apertures 84, 86 and the fastening apertures 122, 124 align, respectively. The split rings 102, 104 are individually and rigidly affixed to the U-shaped yoke 72 by means of machine bolts 130 and washers 132. The bolts 130 engaged the fastening apertures 122, 124 but do not extend through the split rings 102, 104 so as to avoid any interference during the removal process.

During the removal process, the boot removal tool 70 is positioned such that the C-shaped section 106 of the split rings 102, 104 substantially encompasses the metal boot clamp 32 and the land 126 engages the first shoulder 46 thereof, as best shown in FIG. 4. A driving force, such as a blow from a hammer or air hammer (not shown), is exerted upon the driver attachment 90 to force the boot assembly 28 from the universal joint housing 22, thereby exposing the bearing 24.

Also, the boot removal tool 70 may be utilized to assist in the replacement of a boot 30 on the universal joint housing 22. That is, referring to the drawing FIG. 4, the tool 70 can be reversed from the position depicted in FIG. 4 and utilized to assist in replacing the boot 30 and clamp 32. A driving force upon the driver attachment 90 thus can be relied upon to drive the ring 102 against the clamp 32 to therby force the boot assembly 28 onto the housing 22 to cover the bearing 24. In sum, the tool may be used to remove the boot assembly 28 as well as to replace the boot assembly 28.

A single embodiment of the present invention has been described herein. It is to be understood, however, that changes and modifications can be made without departing from the true scope and spirit of the present invention. That scope and spirit is defined by the following claims, which are to be interpreted in view of the foregoing.

What is claimed is:

1. A universal joint boot, removal tool comprising, in combination:

an integral U-shaped yoke having first and second, elongate, parallel, spaced extension legs and a transverse interconnecting leg, said legs formed from a single bar, each of said extension legs having a generally constant size rectangular cross section end portion with a transverse ring locking aperture, at the end thereof opposite said interconnecting leg, the apertures being substantially coaxial and transverse to the extension legs, said interconnecting leg including a centrally-located attachment aperture;

an integral driver attachment adapted to engage said attachment aperture, said driver attachment being rigidly secured to said interconnecting leg of said integral U-shaped yoke;

a removable split ring member having a generally cylindrical inside surface with an inside diameter, and a generally circumferential abutment land on the inside surface for engagement with a universal boot assembly, the outside surface of the split ring member being generally cylindrical and also including first and second pairs of flanges extending outwardly from said ring member so as to define a pair of diametrically opposed slots in the outside surface of the ring member, said slots transversely spaced by a fixed distance substantially equal to the spacing of the ends of the extension legs, each slot adapted to receive one end of said extension legs in an assembled state, each slot further including a threaded fastening aperture, each aperture centrally located within said diametrically opposed slots and aligned with said ring-locking apertures of said legs in said assembled state; and a pair of bolts rigidly, individually, and removably securing said extension legs in said split ring slots, said bolts engaging said threaded fastening apertures and extending only partially into said ring member to retain the ring member attached to the extension legs and prevent twisting of said ring member when mechanical force is applied to the tool through the driver attachment, said legs defining means for cooperation with any ring member having cooperative, parallel, extension slots spaced said fixed distance regardless of the inner surface diameter and configuration.

2. The tool of claim 1 wherein the driver attachment includes an integral circumferential grip for cooperation with a driver tool.

* * * * *